US006608319B2

(12) United States Patent
Joseph

(10) Patent No.: US 6,608,319 B2
(45) Date of Patent: Aug. 19, 2003

(54) FLEXIBLE AMORPHOUS COMPOSITION FOR HIGH LEVEL RADIATION AND ENVIRONMENTAL PROTECTION

(75) Inventor: Adrian Joseph, 5 Old Ranch Rd., Laguna Niguel, CA (US) 92677

(73) Assignee: Adrian Joseph, Laguna Niguel, CA (US)

( * ) Notice: Subject to any disclaimer, the term of this patent is extended or adjusted under 35 U.S.C. 154(b) by 220 days.

(21) Appl. No.: 09/878,005

(22) Filed: Jun. 8, 2001

(65) Prior Publication Data

US 2002/0185614 A1 Dec. 12, 2002

(51) Int. Cl.[7] ..... G21F 1/00; G21F 1/02; G21F 1/06; G21F 1/108; G21F 1/10

(52) U.S. Cl. ..... 250/519.1; 250/515.1; 250/518.1; 250/506.1

(58) Field of Search ..... 250/505.1, 506.1, 250/515.1, 518.1, 519.1; 524/407; 523/136

(56) References Cited

U.S. PATENT DOCUMENTS 6,232,383 B1 5/2001 Joseph ..... 524/400

*Primary Examiner*—Huan Tran
(74) *Attorney, Agent, or Firm*—Reed Smith Crosby Heafey

(57) ABSTRACT

An improved nuclear shielding material that is flexible so as to effectively fill voids in radiation containment structures. Under very high temperatures the material is designed to undergo pyrolysis and transform into a strong ceramic material. The material contains a number of components, the first of which is a polymeric elastomer matrix such as a two part self-polymerizing system like RTF silicone rubber. Additional components include: a compound to shield gamma radiation like tungsten carbide powder, a neutron absorbing/gamma blocking compound such as boron carbide powder, a heat conducting material such as diamond powder, a high temperature resistant compound such as silicon dioxide powder, a second neutron absorbing compound which also imparts electrical conductivity, namely barium sulfate powder, and a hydrogen gas surpassing component which readily absorbs hydrogen such as sponge palladium.

16 Claims, No Drawings

FLEXIBLE AMORPHOUS COMPOSITION FOR HIGH LEVEL RADIATION AND ENVIRONMENTAL PROTECTION

BACKGROUND OF THE INVENTION

1. Area of the Art

The present invention concerns the field of materials resistant to environmental extremes and in particular resistant to high radiation levels.

2. Description of the Prior Art

Nuclear energy and radioactive materials have posed seemingly insurmountable problems. There has been great public concern surrounding safety issues related to nuclear power plants, their design and operation. It appears that safe reactors are within the grasp of human engineering. The real problem posed may well be an environmental one caused by recycling and disposal of the spent nuclear fuels. Whether the spent fuels are reprocessed to yield additional fissionable material (the most efficient alternative from the view of long term energy needs) or whether the spent fuel is simply disposed of directly, there is a considerable volume of highly radioactive substances that must be isolated from the environment for long periods of time. The presently planned approach is the internment of the radioactive material in deep geologic formations where they can decay to a harmless level. Ideally these "buried" wastes will remain environmentally isolated with no monitoring or human supervision. Unfortunately, one does not simply dump the wastes in a hole. These materials are constantly generating heat, and the emitted radiation alters and weakens most materials. This makes it difficult to even contain the materials, as the weakened containers are prone to breakage and leaking. Furthermore, potentially explosive gases, primarily hydrogen, are generated by interaction of radiation with many shielding materials. These problems impact both wastes and nuclear power plants. The safest possible design is to little avail if the structural elements of the power plant or the storage vessel deteriorate and/or experience hydrogen explosions.

In terms of waste the best present approach is to reduce the wastes to eliminate flammable solvents. The reduced wastes are then vitrified or otherwise converted into a stable form to prevent environmental migration. Generally, the reduced wastes (including spent fuel rods) are placed into a strong and resistant container for shipping and disposal. Ideally this container would show considerable shielding properties to facilitate transport and handling. In terms of nuclear power plants conventional shielding materials are often employed. The hope is to replace such materials or decommission the power plant before there is excess deterioration. Nevertheless, there remains the important task of producing special materials that display unusual resistance to radiation, heat and chemical conditions that generally accompany nuclear plants and radioactive wastes. Ideally, such materials have radiation shielding properties and can be used to shield and incase otherwise reduced wastes as well as decommissioned or damaged nuclear facilities.

The simplest and crudest of such materials is probably concrete. Because of the mineral inclusions in simple portland cement based materials or similar materials to which additional shielding materials (e.g. heavy metal particles) these substances provide shielding of nuclear radiation. However, simple concrete may not long survive under the severe chemical conditions provided by some nuclear facilities. In many applications the inherent brittleness of the concrete is a problem. When jarred or dropped, the material may develop cracks or leaks. Concrete tanks of liquid nuclear wastes have useful lifetimes of less than fifty years. Concrete is more effective against reduced vitrified wastes but is still far from ideal. There have also been a number of experiments with novel shielding-containment materials that would be easier to apply and have superior shielding and/or physical properties. The present inventor has disclosed such materials in U.S. Pat. No. 6,232,383. Although the material disclosed therein is a great advance over the prior art, it is not optimal in all aspects. The material shows tremendous tensile strength but is not ideal for applications where a certain amount of flexibility is desirable. Further, the disclosed formulae may not always show optimal resistance to radiation induced production of hydrogen (radiolysis).

SUMMARY OF THE INVENTION

The present invention is an improved nuclear shielding material that is initially flexible so as to effectively fill voids in radiation containment structures. The material is based on an amorphous organic matrix and is resistant to heat and radiation. Under very high temperatures the material is designed to undergo pyrolysis and transform into a strong ceramic material that retains the favorable radiation and hydrogen resistance of the original material.

As such the composition consists of uniform mixture of seven different component groups. The first component is a polymeric elastomer matrix such as a two part self-polymerizing system like RTF silicone rubber and constitutes about 10%–30% by weight of the final composition. The second component is a material to act as a gamma radiation shield, like tungsten carbide powder; the gamma shielding material makes up about 25%–75% by weight of the final composition. The third component is a neutron absorbing/gamma blocking material such as boron carbide powder and constitutes about 5%–10% by weight of the final composition. The fourth component is a heat conducting material such as diamond powder and makes up between about 0% and 5% by weight of the final composition. The fifth component is a high temperature resistant compound such as silicon dioxide powder which makes up between about between 0% and 5% by weight of the final composition. The sixth component is a second neutron absorbing compound which also imparts electrical conductivity, namely barium sulfate powder which makes up between 0% and 2% by weight of the final composition. Lastly, the seventh component is a hydrogen gas surpassing component which readily absorbs hydrogen—materials such as sponge palladium or other metals or intermetallic compounds—and constitutes about 2–8% of the final composition.

The organic elastomer (first component) is preferably a two-part catalyst system so that all of the other components can be uniformly mixed together and then uniformly mixed into Part A of the RTF. Finally, Part B of the RTF is blended into the mixture which is then injected into its final location where it foams. polymerizes and hardens. Alternatively, other components can be uniformly blended into a mixture. Then part A and part B of the RTF can be uniformly blended and that mixture rapidly blended with the other component mixture and the resulting mixture injected into place before foam formation and polymerization heating has taken place.

DETAILED DESCRIPTION OF THE INVENTION

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein specifically to provide an improved nuclear shielding material that resists damage caused by radiation induced hydrogen production.

The present invention is an improved nuclear shielding material that is initially flexible so as effectively to fill voids in radiation containment structures. The material is based on an amorphous organic matrix and is resistant to heat and radiation. Under very high temperatures the material is designed to undergo pyrolysis and transform into a strong ceramic material that retains the favorable radiation and hydrogen resistance of the original material. As such the composition consists of uniform mixture of up to seven different component groups. Abbreviated descriptions are given here with more detail below:

1) An organic polymeric elastomer matrix (ideally a two part self-polymerizing system)(about 10%–30% by weight of the final composition);
2) A gamma radiation shielding component (for example, tungsten carbide powder, 99% pure, 50–200 μm average grain size preferred)(about 25%–75% by weight of the final composition);
3) A neutron absorbing/gamma blocking component (for example, boron carbide powder, 50–200 μm average grain size preferred)(about 5%–10% by weight of the final composition);
4) A heat conducting component (diamond powder, 50–200 μm average grain size preferred)(about 0%–5% by weight of the final composition);
5) A high temperature resistant component (silicon dioxide powder, 50–200 μm average grain size preferred) (about 0%–5% by weight of the final composition);
6) A neutron absorbing/electrical conductivity-enhancing component (barium sulfate powder) (about 0%–5% by weight of the final composition); and
7) A hydrogen gas absorbing component (sponge palladium or other metals or intermetallic compounds that readily absorb hydrogen)(about 2%–8% by weight Sof the final composition).

The first component (component group one) is a flexible organic matrix in which all of the other components are evenly suspended. The matrix material is preferably a flexible silicon rubber material (such as RTF 762 manufactured by the Silicon Division of General Electric Corporation). This organic elastomer is a two-part catalyst system so that all of the other component groups can be uniformly mixed together and then uniformly mixed into Part A of the RTF ('RTF' stands for "room temperature foam"). Finally, Part B of the RTF is blended into the mixture, which is then injected into its final location where it foams, polymerizes and hardens. Alternatively, components 2–7 can be uniformly blended into a mixture. Then part A and part B of the RTF can be uniformly blended and that mixture rapidly blended with the 2–7 component mixture with the resulting mixture being injected into place before foam formation and heating has substantially occurred.

The matrix provides the required flexibility, shock resistance and tensile strength to the material. Depending on formulation the matrix can exist in a porous or non-porous state. Non-porous matrices can be formed with RTV ("room temperature vulcanization") silicone rubber products. The advantage of the foam materials is somewhat lower weight and the ability to expand and fill voids upon injection into a structure. The goal is to eliminate all voids that are larger than about 5 mm because under intense radiation such voids can accumulate hydrogen gas and pose a danger of explosion. Alternatively, use of a non-foam matrix (e.g., RTV) can show increased strength and shielding ability, which may be advantageous under certain circumstance.

An important consideration in the choice of RTF for the matrix material is the existence of aromatic radicals in the polymer. Various studies have shown that aromatic materials show a much higher radiation resistance than do, for example, polysiloxanes with mostly aliphatic radicals. A study on the radiation resistance of isoprene rubber demonstrated that the addition of polycyclic aromatic compounds greatly increased the rubber's resistance to radiation. Benzantracene, diphenyl and phenantrene were shown to be the most effective. With such additives rubber irradiated in a vacuum was able to withstand a dose of 400 Mrad without appreciable structural deterioration. It is believed that aromatic rings afford a route for intramolecular transfer and dissipation of excitation energy. This significantly reduces the amount of hydrogen released on irradiation. That is, the aromatic carbon—carbon bonds involved in these polymers are resistant to radiation loads and environmental attacks. Polymers containing aromatic radicals, and especially benzantracene, diphenyl and phenantrene groups are especially preferred in the present invention.

Other organic matrix elastomers and polymers are also usable in the present invention including siloxanes, silanols, vinyl elastomers (such as polyvinyl chlorides), and fluorocarbon polymers and elastomers. Again, polymers containing aromatic radicals are preferred.

While the matrix provides basic strength and flexibility, the other six components provide various types of radiation resistance and/or enhancement to the basic mechanical-physical properties of the matrix.

Component 2 provides significant shielding against gamma radiation. Gamma radiation shielding is important both because it limits the amount of dangerous gamma radiation exiting the shielded container (where is could be a biological hazard) and because the shielding limits the exposure of matrix material to strong radiation. Such exposure results in the gradual deterioration of the matrix and in the radiolytic production of hydrogen, which may result in a fire or explosion hazards. In situations with particularly high radiation fluxes as in containers for spent nuclear fuel, Component 2 can advantageously be supplemented with one or more additional shielding compounds. Such shielding compounds are generally powders of chemically pure heavy metals such as lead, tin, antimony, indium, and bismuth. These choices are a matter of balancing the opposing factors of cost, weight and requirement for shielding. While pure metal powders are useful, it is also advantageous to use salts of the shielding metals. Iodide salts can be especially advantageous because iodine itself is a good shielding material.

Tungsten carbide is preferred as a primary shielding material (although metallic tungsten powder can also be used) because it is physically compatible with the matrix (i.e., the matrix polymers bind to the carbide) and because it can form a ceramic component under pyrolytic conditions. To this end oxides of heavy metals such as cerium and zirconium with high melting points (and even lighter ceramic compounds such as magnesium and aluminum oxide) are advantageously included to form a strong ceramic material. As is well understood in the art of refractory ceramics, it is important to avoid the inclusion of ceramic oxides that could form eutectic mixtures with low melting points. The addition of ceramic forming agents is optional and is based on the likelihood of the particular application resulting in sustained temperatures above about 900° C.

Component 3 has the primary task of absorbing neutrons. Because the organic matrix of the present invention is essentially transparent to neutrons, use of this invention without neutron absorbers could result in an increase in neutron flux as compared to other traditional shielding materials such as concrete. In some instances this could even result in a the danger of a chain reaction. The primary neutron absorber used is boron (but also see component 6). Boron is advantageously present as boron carbide because of the physical compatibility with the matrix. However, other forms of boron may also be used. For example, boron nitride may provide advantageous thermal conductivity and strength. In addition, more "exotic" neutron absorbers such as cadmium and gadolinium can be included to supplement the boron.

Component 4, diamond powder, is partially responsible for high temperature resistance of the final product. The various shielding metals of the other components show relatively high thermal conductivity and help conduct heat out of the shielding material, thereby maintaining its favorable flexibility and related properties. However, diamond powder shows extremely high thermal conductivity and well as strength and thermal resistance (in a non-oxidizing atmosphere). Therefore, diamond powder can advantageously be included to help maintain temperature of the matrix below temperatures that would result in pyrolysis. Because the various shielding metals also contribute to thermal conductivity, it is possible to omit the diamond powder especially where the gamma shielding material is present in a metallic state.

Component 5, silicon dioxide, is responsible for thermal resistance and strength at high temperatures. Should pyrolysis occur the silicon dioxide could form part of the newly generated ceramic. If other ceramic-forming metal oxides are included, this component can be omitted.

Component 6, barium sulfate, is also an effective gamma radiation shield and a neutron absorber. In addition, it provides sufficient electrical conductivity to discharge free electrons released by interaction between the inventive composition and a strong radiation flux. These electrons can be involved in radiolytic breakdown and hydrogen production. Discharging or short-circuiting these currents can help avoid radiolytic breakdown and hydrogen formation. Since a primary purpose of component 3 is also neutron absorption, it is possible to omit component 6 particularly when metallic components are included as these components also enhance electrical conuctivity.

Finally, component 7 is included to deal with hydrogen that forms despite the shielding materials and other additives used to minimize its formation. The "gas suppressants" that make up component 7 are metallic and intermetallic compounds that readily absorb and bind hydrogen at relatively low temperatures and low partial hydrogen pressures. These materials include sponge palladium produced, for example, through the thermal decomposition of organo-palladium compounds and various readily "hydrogenated" metals such as lithium, calcium, scandium and titanium. Further, several of these are of sufficiently high atomic weight to also function as gamma shields. Of especial interest are intermetallic compounds such as the various lithium nickel ("lithiated") compounds, lanthanum nickel compounds, samarium cobalt compounds, yttrium nickel compounds and yttrium cobalt compounds, all of which show significant ability to absorb hydrogen.

In some situations, high radiation flux dictates that the hydrogen absorber-gas suppressant will become relatively rapidly saturated with hydrogen. When this occurs, hydrogen will diffuse through the inventive composition because the matrix material is quite permeable to hydrogen. The first thing that will occur is that pores in the material (pores are prevalent in the foam version) will fill with hydrogen. This could result in an explosion hazard as atmospheric oxygen and hydrogen can mix in the pores. However, this danger is considerably minimized by the small pore size of the foam. Generally the pores are smaller than the average effective trace length of radicals active in the hydrogen oxidation reaction (which amounts to several centimeters at atmospheric pressure). Therefore, the probability of developing a self-sustaining oxidation circuit is negligible due to quenching on the walls of the pores. The most likely scenario is that hydrogen will gradually infiltrate the pores and displace other gases therein. Eventually, there will be a steady escape of hydrogen from the surface of the material. Therefore, depending on the rate of hydrogen evolution, it may be necessary to provide some sort of ventilation system to safely gather and dispose of the escaping hydrogen.

Finally, should thermal conductivity enhancers and other precautions fails to keep the composition at a temperature below 1,000° C. or so the composition can undergo a pyrolytic transition (generally at 1,100–1,200° C.) into an extremely strong ceramic. In the ceramic state the flexibility characteristics of the composition are largely lost; however, the overall shielding properties of the material are not significantly altered. If radiation and related conditions make the ceramic transition at all likely, provision should be made to exhaust the various gases released by pyrolysis. Ventilation systems provided to deal with hydrogen efflux could also serve to remove pyrolytic gases.

While the possible ranges of components is fairly broad, following is a currently preferred "recipe" for an effective nuclear shielding composition according to the present invention. The major component by weight is Component 2 (tungsten carbide powder of 99.99% purity) which makes up 55% by weight of the final composition. Component 3 is a mixture of boron carbide and boron nitride wherein the carbide makes up 4% and the nitride 1% by weight of the final composition. Component 4 is industrial diamond powder which makes up 0.5% by weight of the composition. Component 5 is quartz powder, which makes up 4.5% by weight of the final composition. Component 6 is barium sulfate which makes up 3% by weight of the final composition and component 7 is a gas absorber-suppressant which makes up 7% by weight of the final composition (this consists of an equal weight mixture of lanthanum/nickel and samarium/cobalt compounds to yield 4% by weight and further of hydrogenatable titanium to yield 3% by weight).

These materials are thoroughly blended in an industrial mixer until the mixture is completely uniform. Then this mixture is thoroughly blended into RTF material Part A (an amount equivalent to 20% by weight of the final mixture). Finally, 5% by weight of the final composition of RTF Part B is blended in and the material is injected into a mold (or a cavity in a waste container) and allowed to polymerize.

The inventive material is flexible and quite resistant to high temperatures and high radiation fluxes. If held at a high temperature it will transform into a strong ceramic especially if formulated with ceramic metal oxides as is understood by one of skill in the art. The composition is useful as a shielding component in any high radiation application. Especially suitable are nuclear power plants, nuclear fuel processing and reprocessing facilities and facilities for storage of spent nuclear fuels. For example, a good application of the present invention is as a shielding material in containers designed for transport and/or storage of spent nuclear fuels. One such container can be produced by making an container sized to hold a spent fuel rod assembly. The container is best fabricated from a strong and thermally/chemically resistant metal such as stainless steel. The container is fabricated with a double wall construction wherein a space exists between the inner wall and the outer wall. This space is filled by the composition of the present invention—preferably in a foam formulation. That is, after the components are completely mixed with the silicone rubber Part A, the silicone rubber Part B is rapidly mixed in and the resulting mixture is injected into the space of the container. The mixture foams to completely fill the space and polymerizes to provide a resistant shielding material. A double-walled lid for the container is constructed along the same lines. The shielding material greatly attenuates the escaping radiation making transport and storage much safer.

The following claims are thus to be understood to include what is specifically illustrated and described above, what is conceptually equivalent, what can be obviously substituted and also what essentially incorporates the essential idea of the invention. Those skilled in the art will appreciate that various adaptations and modifications of the just-described preferred embodiment can be configured without departing from the scope of the invention. The illustrated embodiment has been set forth only for the purposes of example and that should not be taken as limiting the invention. Therefore, it is to be understood that, within the scope of the appended claims, the invention may be practiced other than as specifically described herein.

I claim:

1. A flexible composition able to stop high fluxes of gamma and neutron radiation and showing resistance to high temperatures, said composition comprising a uniform mixture of:

between about 10%–30% by weight an organic polymer selected from the group consisting of silicone rubber, siloxanes, silanols, vinyl elastomers and fluorocarbon polymers for providing a flexible matrix;

between about 25%–75% by weight of a powdered gamma radiation shielding material selected from the group consisting of tungsten, lead, tin, antimony, indium and bismuth for increasing gamma radiation shielding of the mixture;

between about 5%–10% by weight of a neutron absorbing material selected from the group consisting of boron, cadmium and gadolinium for increasing neutron absorption of the mixture;

up to about 5% by weight diamond powder for increasing thermal conductivity of the mixture;

up to about 5% by weight powdered silicon dioxide for increasing thermal resistance of the mixture;

up to about 5% by weight of barium sulfate powder for increasing neutron absorption and electrical conductivity of the mixture; and between about 2% and 8% by weight of a hydrogen absorbing material selected from the group consisting of palladium, lithium, calcium, titanium, scandium, lithium nickel compounds, lanthanum nickel compounds, yttrium nickel compounds, samarium cobalt compounds and yttrium cobalt compounds for absorbing hydrogen gas.

2. The mixture of claims 1, wherein the organic polymer comprises a silicone rubber.

3. The mixture of claims 2, wherein the silicone rubber is formulated to produce a flexible foam upon polymerization.

4. The mixture of claims 1, wherein the gamma shielding material comprises tungsten.

5. The mixture of claims 4, wherein the tungsten comprises tungsten carbide.

6. The mixture of claims 1, wherein the gamma shielding material is metallic.

7. The mixture of claims 1, wherein the gamma shielding material is a salt.

8. The mixture of claims 7, wherein the salt comprises an iodide.

9. The mixture of claims 1, wherein the neutron absorbing material comprises boron.

10. The mixture of claims 9, wherein the boron comprises one of boron carbide, boron nitride and a mixture of boron carbide and boron nitride.

11. The mixture of claims 1, wherein the powdered silicon dioxide comprises quartz.

12. The mixture of claims 1, wherein the hydrogen absorbing material comprises sponge palladium.

13. The mixture of claims 1, wherein the organic polymer is silicone rubber foam, the gamma radiation shielding material is tungsten carbide, the neutron absorbing material is a mixture of boron carbide and boron nitride, and the hydrogen absorbing material comprises a mixture of titanium, a lanthanum nickel compound and a samarium cobalt compound.

14. A container for highly radioactive material comprising:

an inner container;

an outer container surrounding the inner container and spaced apart therefrom; and a space between the inner container and the outer container, said space filled with the composition of claim 1.

15. A flexible composition able to stop high fluxes of gamma and neutron radiation and showing resistance to high temperatures, said composition comprising a uniform mixture of:

between about 10%–30% by weight silicone rubber for providing a flexible matrix;

between about 25%–75% by weight of powdered tungsten for increasing gamma radiation shielding of the mixture;

between about 5%–10% by weight of powdered boron for increasing neutron absorption of the mixture;

up to about 5% by weight diamond powder for increasing thermal conductivity of the mixture;

up to about 5% by weight powdered silicon dioxide for increasing thermal resistance of the mixture;

up to about 5% by weight of barium sulfate powder for increasing neutron absorption and electrical conductivity of the mixture; and between about 2% and 8% by weight of a hydrogen absorbing material selected from the group consisting of palladium, lithium, calcium, titanium, scandium, lithium nickel compounds, lanthanum nickel compounds, yttrium nickel compounds, samarium cobalt compounds and yttrium cobalt compounds for absorbing hydrogen gas.

16. A container for highly radioactive material comprising:

an inner container;

an outer container surrounding the inner container and spaced apart therefrom; and a space between the inner container and the outer container, said space filled with the composition of claim 15.

* * * * *